US009942959B1

(12) United States Patent
Zheng et al.

(10) Patent No.: US 9,942,959 B1
(45) Date of Patent: Apr. 10, 2018

(54) PHASE-CUT DIMMABLE POWER SUPPLY WITH WIDE INPUT VOLTAGE

(71) Applicant: Zhuhai Shengchang Electronics Co., Ltd., Zhuhai (CN)

(72) Inventors: Dehua Zheng, Zhuhai (CN); Xianyun Zhao, Zhuhai (CN)

(73) Assignee: Zhuhai Shengchang Electronics Co., Ltd., Zhuhai (CN)

( * ) Notice: Subject to any disclaimer, the term of this patent is extended or adjusted under 35 U.S.C. 154(b) by 0 days.

(21) Appl. No.: 15/679,172

(22) Filed: Aug. 17, 2017

(30) Foreign Application Priority Data

Mar. 29, 2017 (CN) ..... 2017 1 0195106
Mar. 29, 2017 (CN) ..... 2017 2 0314022 U

(51) Int. Cl.
*H05B 33/08* (2006.01)

(52) U.S. Cl.
CPC ..... *H05B 33/0845* (2013.01); *H05B 33/0818* (2013.01)

(58) Field of Classification Search
CPC ..... H05B 33/0815; H05B 33/0818; H05B 33/0845; H05B 33/0851; H05B 37/02; H05B 41/38; H05B 41/3924; H05B 41/3927; Y02B 20/346
See application file for complete search history.

(56) References Cited

U.S. PATENT DOCUMENTS 8,552,662 B2 * 10/2013 Sun ..... H05B 33/0818 315/294
8,587,209 B2 * 11/2013 Soleno ..... H05B 33/0815 315/206
9,591,710 B1 * 3/2017 Zheng ..... H05B 33/0845
9,609,713 B1 * 3/2017 Zheng ..... H05B 33/0812
2013/0193879 A1 * 8/2013 Sadwick ..... H05B 33/0818 315/307

* cited by examiner

*Primary Examiner* — Haissa Philogene
(74) *Attorney, Agent, or Firm* — Gokalp Bayramoglu

(57) ABSTRACT

The present invention discloses a wide input voltage phase-cut dimming power supply, which is embedded in an overall dimming circuit. The overall dimming circuit includes an electric network power supply, a phase-cut dimmer, a dimming power supply, and an LED light. The dimming power supply includes an anti-interference circuit, an active power factor correction circuit, a power conversion circuit, a dimmer current maintaining circuit, a wide input voltage phase-cut dimming control circuit, and a filed effect transistor. Compared to the prior art, the present invention can realize a wide input voltage within 90-305V, which is suitable for most of electric networks around the world. Furthermore, the present invention uses a PWM control mode, so that it can control brightness of the LED lights with different colors, and be compatible with a leading edge dimmer or a trailing edge dimmer.

6 Claims, 3 Drawing Sheets

PHASE-CUT DIMMABLE POWER SUPPLY WITH WIDE INPUT VOLTAGE

CROSS REFERENCE TO RELATED APPLICATIONS

This application is based upon and claims priority to Chinese Patent Application No. 2017101951065, filed on Mar. 29, 2017, and Chinese Patent Application No. 2017203140224, filed on Mar. 29, 2017, the entire contents of which are incorporated herein by reference.

TECHNICAL FIELD

The present invention relates to a phase-cut dimming power supply, particularly relates to a wide input voltage phase-cut dimming power supply.

BACKGROUND

The phase-cut dimming mode has some advantages. It is convenient for users to install and wire the circuit. Further, it is easy to convert the lighting circuit wiring in the old buildings into a lighting solution with a dimming function. Hence, the phase-cut dimming mode is more and more widely used. However, the input voltage range of the current phase-cut dimming power supply is narrow. For example, the input voltage range of the phase-cut dimming power supply which is suitable for the regions of China, Europe, Australia etc. is within 170-265V, and the input voltage range of the phase-cut dimming power supply which is suitable for the regions of North America, Japan etc. is within 90-130V. Therefore, there is no phase-cut dimming power supply having an input range within 90-305V, which is suitable for most of electrical networks in the whole world. Besides, some available phase-cut dimming power supplies still use power regulation to realize phase-cut dimming. The phase-cut power supplies in this mode have some problems. For example, the load power is limited. Further, it cannot adjust various LED lights with different colors at the same time and the input voltage range is narrow. There are also some available phase-cut dimming power supplies using a PWM control. Even though various LED lights with different colors can be adjusted in this mode, this mode can only be used in a phase-cut power supply with a narrow input voltage range, since it collects the voltage amplitude of the input voltage to generate a control signal.

As described above, there are deficiencies, including limited load power, failure to adjust various LED lights at the same time, narrow input voltage range, etc., in the existing phase-cut dimming power supplies.

SUMMARY OF THE INVENTION

The problem which is intended to be solved by the present invention is to overcome the deficiencies of the prior art, and provide a phase-cut dimming power supply with some advantages. For example, there is no limit to the power loading, the efficiency is high. Further, it can adjust various LED lights with different colors at the same time, is highly compatible with phase-cut dimmers, and can realize a wide input range within 90-305V, etc.

The technical solutions of the present invention are as below: A wide input voltage phase-cut dimming power supply embedded in an overall dimming circuit is provided. The overall dimming circuit comprises an electric network power supply, a phase-cut dimmer, a dimming power supply, and an LED light, which are sequentially connected; a current of the electric network power supply is provided as input to the dimming power supply through the phase-cut dimmer, and the dimming power supply supplies a working power to the LED light, wherein the dimming power supply comprises an anti-interference circuit, an active power factor correction circuit, a power conversion circuit, a dimmer current maintaining circuit, a wide input voltage phase-cut dimming control circuit, and a field effect transistor; an input terminal of the anti-interference circuit is connected to an output terminal of the phase-cut dimmer, an output terminal of the anti-interference circuit is connected to input terminals of the active power factor correction circuit, the dimmer current maintaining circuit, and the wide input voltage phase-cut dimming control circuit respectively; an output terminal of the active power factor correction circuit is connected to an input terminal of the power conversion circuit; an output terminal of the power conversion circuit supplies a working power to the LED light via the filed effect transistor; a control terminal of the filed effect transistor is connected to an output terminal of the wide input voltage phase-cut dimming control circuit.

The wide input voltage phase-cut dimming control circuit comprises a first diode, a second diode, a first resistor, a second resistor, a comparator, a reference source, a PWM signal conversion circuit, a photoelectric coupler, and a PWM signal adjustment circuit; positive terminals of the first diode and the second diode are respectively connected to two output terminals of the anti-interference circuit; negative terminals of the first diode and the second diode are connected to each other, and then connected to one terminal of the first resistor; an other terminal of the first resistor is connected to one terminal of the second resistor and a positive terminal of the comparator; a negative terminal of the comparator is connected to one terminal of the reference source, an other terminal of the reference source is connected to an other terminal of the second resistor and a common ground terminal of the wide input voltage phase-cut dimming control circuit; a power terminal of the comparator is connected to a VCC; an output terminal of the comparator is connected to an input terminal of the PWM signal conversion circuit; an output terminal of the PWM signal conversion circuit is connected to a light emitting diode of the photoelectric coupler; a transistor of the photoelectric coupler is connected to an input terminal of the PWM signal adjustment circuit; an output terminal of the PWM signal adjustment circuit is connected to the control terminal of the filed effect transistor.

Alternatively, the wide input voltage phase-cut dimming control circuit comprises a first diode, a second diode, a first resistor, a second resistor, a third resistor, a comparator, a reference source, a PWM signal conversion circuit, a photoelectric coupler, and a PWM signal adjustment circuit; positive terminals of the first diode and the second diode are respectively connected to two output terminals of the anti-interference circuit; negative terminals of the first diode and the second diode are connected to each other and then connected to one terminal of the first resistor; an other terminal of the first resistor is connected to one terminal of the second resistor and a positive terminal of the comparator; a negative terminal of the comparator is connected to one terminal of the reference source, an other terminal of the reference source is connected to an other terminal of the second resistor and a common ground terminal of the wide input voltage phase-cut dimming control circuit; a power terminal of the comparator is connected to a VCC; an output terminal of the comparator is connected to a positive terminal of a light emitting diode of the photoelectric coupler; a negative terminal of the light emitting diode of the photoelectric coupler is connected to one terminal of the third resistor; an other terminal of the third resistor is connected to a common ground terminal of the wide input voltage phase-cut dimming control circuit; a transistor of the photoelectric coupler is connected to an input terminal of the PWM conversion circuit; an output terminal of the PWM conversion circuit is connected to an input terminal of the PWM signal adjustment circuit; an output terminal of the PWM signal adjustment circuit is connected to the control terminal of the filed effect transistor.

The beneficial advantages of the present invention are as below: The wide input voltage phase-cut dimming power supply of the present invention is connected and worked in the overall dimming circuit. The overall dimming circuit comprises an electric network power supply, a phase-cut dimmer, a dimming power supply, and a LED light, which are sequentially connected. A current of the electric network power supply is input into the dimming power supply through the phase-cut dimmer. The dimming power supply supplies a working power to the LED light. The dimming power supply includes an anti-interference circuit, an active power factor correction circuit, a power conversion circuit, a dimmer current maintaining circuit, a wide input voltage phase-cut dimming control circuit, and a filed effect transistor. The input terminal of the anti-interference circuit is connected to the output terminal of the phase-cut dimmer, and the output terminal of the anti-interference circuit is connected to input terminals of the active power factor correction circuit, the dimmer current maintaining circuit, and the wide input voltage phase-cut dimming control circuit respectively. The output terminal of the active power factor correction circuit is connected to the input terminal of the power conversion circuit. The output terminal of the power conversion circuit provides a working power to the LED light via the filed effect transistor. The control terminal of the filed effect transistor is connected to the output terminal of the wide input voltage phase-cut dimming control circuit. The active power factor correction circuit can play a role in power factor correction to provide a stable working voltage for the power conversion circuit. Further, with the cooperation of active power factor correction circuit and the wide input voltage phase-cut dimming control circuit, the present invention, i.e., the wide input voltage phase-cut dimming power supply can easily realize the wide input voltage within 90-305V. Besides, the PWM output mode is used in the wide input voltage phase-cut dimming control circuit, so that various LED lights with different colors can be adjusted. The cooperation of the active power factor correction circuit and the power conversion circuit can easily realize a high efficiency and a high power factor of the wide input voltage phase-cut dimming power supply.

DETAILED DESCRIPTION OF THE EMBODIMENTS

Figure 1:
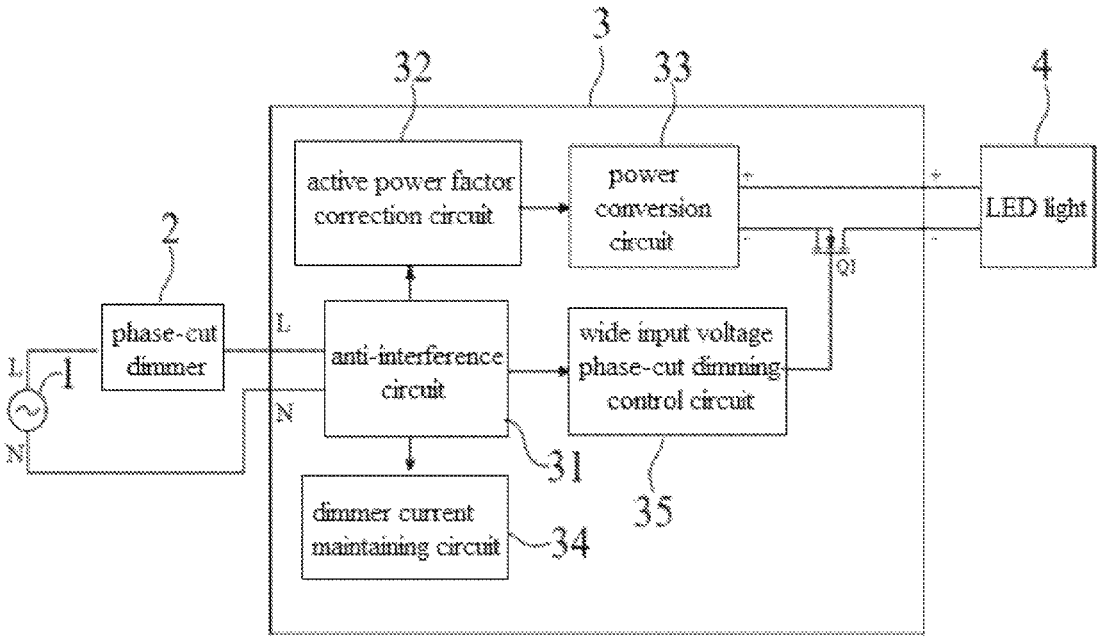
FIG. 1 is a block schematic diagram of the system structure of the present invention.
Figure 2:
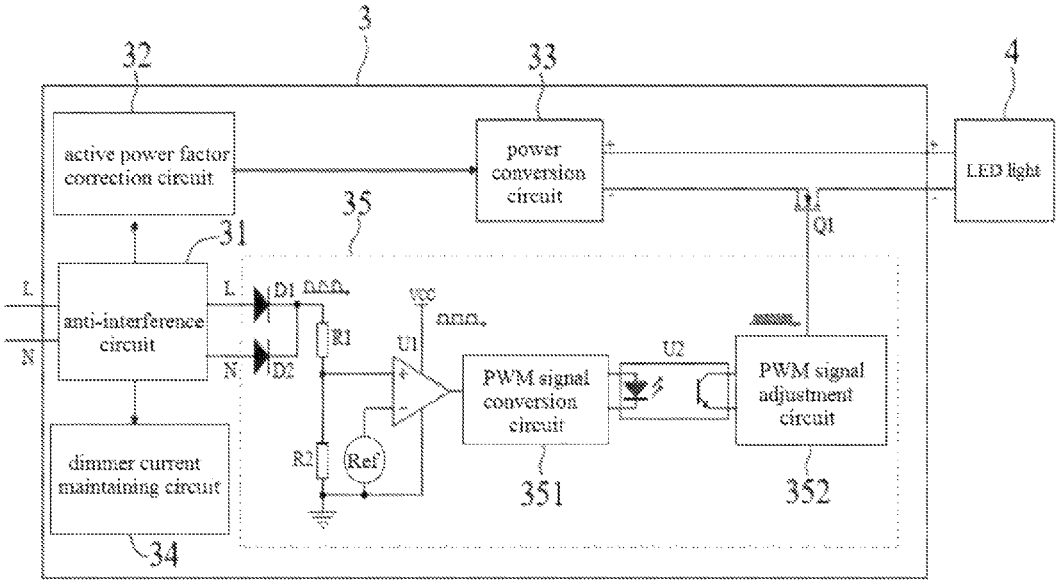
FIG. 2 is a circuit schematic diagram of the embodiment 1 of the present invention.
Figure 3:
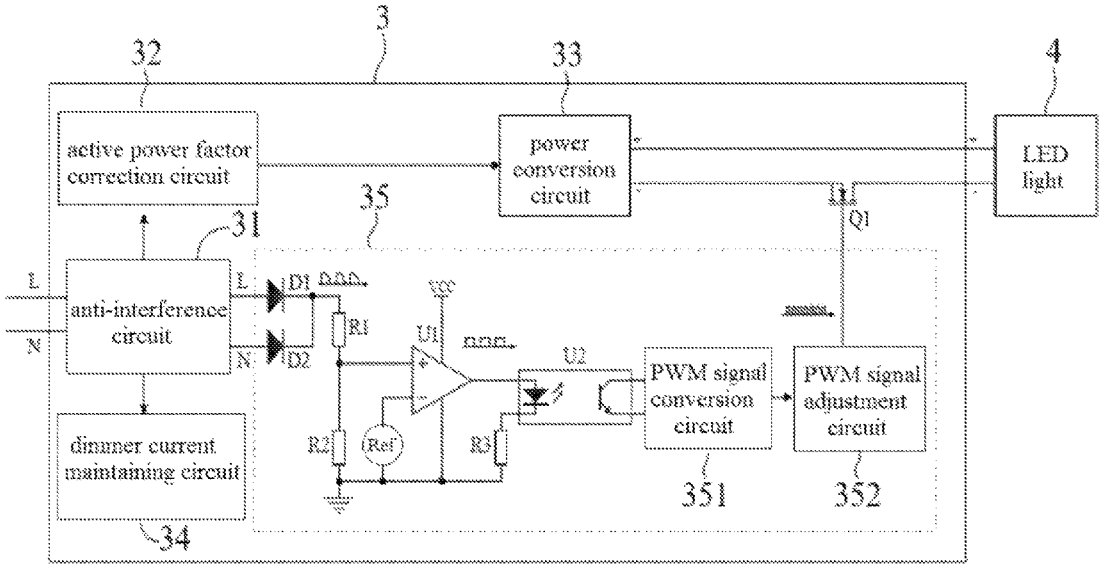
FIG. 3 is a circuit schematic diagram of the embodiment 2 of the present invention.

As shown in FIG. 1 to FIG. 3, a wide input voltage phase-cut dimming power supply connected and worked in an overall dimming circuit is provided. The overall dimming circuit comprises electric network power supply 1, phase-cut dimmer 2, dimming power supply 3, and LED light 4, which are sequentially connected. A current of electric network power supply 1 is provided as input to dimming power supply 3 through phase-cut dimmer 2. Dimming power supply 3 supplies a working power to LED light 4. Dimming power supply 3 includes anti-interference circuit 31, active power factor correction circuit 32, power conversion circuit 33, dimmer current maintaining circuit 34, wide input voltage phase-cut dimming control circuit 35, and filed effect transistor Q1. An input terminal of anti-interference circuit 31 is connected to an output terminal of phase-cut dimmer 2. An output terminal of anti-interference circuit 31 is connected to input terminals of active power factor correction circuit 32, dimmer current maintaining circuit 34, and wide input voltage phase-cut dimming control circuit 35. An output terminal of active power factor correction circuit 32 is connected to an input terminal of power conversion circuit 33. An output terminal of power conversion circuit 33 provides a working power to LED light 4 via a control of filed effect transistor Q1. A control terminal of filed effect transistor Q1 is connected to an output terminal of wide input voltage phase-cut dimming control circuit 35.

As shown in FIG. 2, wide input voltage phase-cut dimming control circuit 35 in the embodiment 1 includes diode D1, diode D2, resistor R1, resistor R2, comparator U1, reference source Ref, PWM signal conversion circuit 351, photoelectric coupler U2, and PWM signal adjustment circuit 352. Positive terminals of diode D1 and diode D2 are respectively connected to two output terminals of anti-interference circuit 31. Negative terminals of diode D1 and diode D2 are connected to each other and then connected to one terminal of resistor R1. The other terminal of resistor R1 is connected to one terminal of resistor R2 and a positive terminal of comparator U1. A negative terminal of comparator U1 is connected to one terminal of reference source Ref, the other terminal of reference source Ref is connected to the other terminal of resistor R2 and a common ground terminal of the circuit. A power terminal of comparator U1 is connected to a VCC. The output terminal of comparator U1 is connected to an input terminal of PWM signal conversion circuit 351. An output terminal of PWM signal conversion circuit 351 is connected to a light emitting diode of photoelectric coupler U2. A transistor of photoelectric coupler U2 is connected to input terminals of PWM signal adjustment circuit 352. An output terminal of PWM signal adjustment circuit 352 is connected to the control terminal of filed effect transistor Q1.

As shown in FIG. 3, wide input voltage phase-cut dimming control circuit 35 in the embodiment 2 includes diode D1, diode D2, resistor R1, resistor R2, comparator U1, reference source Ref, photoelectric coupler U2, PWM signal conversion circuit 351, and PWM signal adjustment circuit 352. Positive terminals of diode D1 and diode D2 are respectively connected to two output terminals of anti-interference circuit 31. Negative terminals of diode D1 and diode D2 are connected to each other and then connected to one terminal of the resistor R1. The other terminal of resistor R1 is connected to one terminal of resistor R2 and a positive terminal of comparator U1. A negative terminal of comparator U1 is connected to one terminal of reference source Ref. The other terminal of reference source Ref is connected to the other terminal of resistor R2 and a common ground terminal of the circuit. A power terminal of comparator U1 is connected to a VCC. An output terminal of comparator U1 is connected to a positive terminal of a light emitting diode of photoelectric coupler U2. A negative terminal of the light emitting diode of photoelectric coupler U2 is connected to one terminal of resistor R3. The other terminal of resistor R3 is connected to a common ground terminal of the circuit. A transistor of photoelectric coupler U2 is connected to an input terminal of PWM conversion circuit 351. An output terminal of PWM conversion circuit 351 is connected to an input terminal of PWM signal adjustment circuit 352. An output terminal of PWM signal adjustment circuit 352 is connected to the control terminal of filed effect transistor Q1.

In the embodiment, after being chopped by phase-cut dimmer 2, the current of electric network power supply 1 is provided as input to anti-interference circuit 31 of wide input voltage phase-cut dimming power supply 3. Anti-interference circuit 31 plays a role in anti-surge and electromagnetic interference reduction. If a bleeder circuit composed of a capacitor and a resistor connected in series is added into anti-interference circuit 31, the compatibility between wide input voltage phase-cut dimming power supply 3 and phase-cut dimmer 2 can be enhanced. After being chopped by phase-cut dimmer 2, an alternating current of electric network power supply 1 is provided as input to active power factor correction circuit 32, dimmer current maintaining circuit 34, and wide input voltage phase-cut dimming control circuit 35 respectively via anti-interference circuit 31. Active power factor correction circuit 32 corrects power factor, reduces the total harmonic content in the circuit, and supplies a direct current with a stable high voltage to power conversion circuit 33. A direct current with a constant voltage or a direct current with a constant current is output through power conversion by power conversion circuit 33, and provided to the matched LED light 4 via field effect transistor Q1. At the same time, this direct current also supplies a working voltage to active power factor correction circuit 32, and wide input voltage phase-cut dimming control circuit 35, etc. Since a relatively high working voltage is provided to power conversion circuit 33 by active power factor correction circuit 32, the working current of power conversion circuit 33 is reduced in case of the same power. If topological circuits, such as quasi-resonant flyback, active clamped forward, LLC, LCC, full bridge circuit etc., are used in power conversion circuit 33, it is easy to realize a high efficient power conversion. Dimmer current maintaining circuit 34 supplies a maintaining current to phase-cut dimmer 2 connected to wide input voltage phase-cut dimming power supply 3, so that a stable work of phase-cut dimmer 2 is ensured. Further, dimmer current maintaining circuit 34 can enhance the compatibility between wide input voltage phase-cut dimming power supply 3 and a leading edge dimmer or a trailing edge dimmer. The chopped alternating current is rectified and then converted into a PWM signal having a frequency same as the frequency of the rectified alternating current by wide input voltage phase-cut dimming control circuit 35. The pulse width of the PWM signal is determined by the phase width of the chopped alternating current. If the phase width of the chopped alternating current is narrower, the pulse width of the PWM signal is smaller, while if the phase width of the chopped alternating current is wider, and the pulse width of the PWM signal is wider. Hence, if the phase width of the chopped alternating current is changed by regulating phase-cut dimmer 2, then the pulse width of the PWM signal is changed accordingly. Furthermore, the pulse width of the PWM signal is irrelevant to the voltage amplitude of the alternating current. Therefore, wide input voltage phase-cut dimming control circuit 35 can achieve a wide input voltage range. The PWM signal is converted into a PWM signal having a frequency more than or equal to 200 Hz by wide input voltage phase-cut dimming control circuit 35. The duty cycle of the converted PWM signal is controlled by the duty cycle of the PWM signal before conversion. The converted PWM signal having a frequency more than or equal to 200 Hz is applied to the gate of filed effect transistor Q1 by wide input voltage phase-cut dimming control circuit 35, to control the switching cycle of filed effect transistor Q1, so that the output of wide input voltage phase-cut dimming power supply 3 is controlled to adjust the brightness of LED light 4.

The PWM signal is generated in a same mode by comparator U1 of the embodiment 1 and comparator U1 of embodiment 2. The only difference between the embodiment 1 and the embodiment 2 is that: In the embodiment 1, the PWM signal generated by comparator U1 is converted into a PWM signal having a frequency more than or equal to 200 Hz by PWM conversion circuit 351. And then, the PWM signal having a frequency more than or equal to 200 Hz is provided as input to PWM signal adjustment circuit 352 at the secondary side of wide input voltage phase-cut dimming power supply 3 via photoelectric coupler U2. By contrast, in the embodiment 2, the PWM signal generated by comparator U1 is firstly input into PWM conversion circuit 351 at the secondary side of wide input voltage phase-cut dimming power supply 3 via photoelectric coupler U2. And then, the PWM signal is converted into a PWM signal having a frequency more than or equal to 200 Hz by PWM conversion circuit 351 and the converted PWM signal is directly provided as input to PWM signal adjustment circuit 352. In brief, PWM conversion circuit 351 in the embodiment 1 is arranged at the primary side of wide input voltage phase-cut dimming power supply 3, and in front of photoelectric coupler U2. The PWM signal transmitted by photoelectric coupler U2 is a PWM signal having a frequency more than or equal to 200 Hz, which is converted by PWM conversion circuit 351. By contrast, PWM conversion circuit 351 in the embodiment 2 is arranged at the secondary side of wide input voltage phase-cut dimming power supply 3, and behind photoelectric coupler U2. The PWM signal transmitted by photoelectric coupler U2 is a PWM signal generated from comparator U1.

Compared to the prior art, the present invention can realize a wide input voltage range within 90-305V, which is suitable for most of electric networks in the whole world. Further, the present invention uses a PWM control mode, which can control LED lights with various colors and is compatible with the leading edge phase-cut dimmer or the trailing edge phase-cut dimmer.

The above embodiments are just preferred embodiments of the present invention, and are not intended to limit the scope of the present invention. Any modifications, improvements, or equivalent substitutions within the idea and content of the present invention fall into the claimed scope of the present invention.

What is claimed is:

1. A dimming circuit system, comprising:

an electric network power supply, a phase-cut dimmer, a dimming power supply, and an LED light, winch are sequentially connected; a current of the electric network power supply is provided as input to the dimming power supply through the phase-cut dimmer, and the dimming power supply supplies a working power to the LED light, wherein the dimming power supply comprises an anti-interference circuit, an active power factor correction circuit, a power conversion circuit, a dimmer current maintaining circuit, a phase-cut dimming control circuit, and a filed effect transistor; an input terminal of the anti-interference circuit is connected to an output terminal of the phase-cut dimmer, an output terminal of the anti-interference circuit is connected to input terminals of the active power factor correction circuit, the dimmer current maintaining circuit, and the phase-cut dimming control circuit respectively; an output terminal of the active power factor correction circuit is connected to an input terminal of the power conversion circuit; an output terminal of the power conversion circuit supplies a working power to the LED light via the filed effect transistor; a control terminal of the filed effect transistor is connected to an output terminal of the phase-cut dimming control circuit.

2. The dimming circuit system of claim 1, wherein the phase-cut dimming control circuit comprises a first diode, a second diode, a first resistor, a second resistor, a comparator, a reference source, a PWM signal conversion circuit, a photoelectric coupler, and a PWM signal adjustment circuit; positive terminals of the first diode and the second diode are respectively connected to two output terminals of the anti-interference circuit; negative terminals of the first diode and the second diode are connected to each other, and then connected to one terminal of the first resistor; an other terminal of the first resistor is connected to one terminal of the second resistor and a positive terminal of the comparator; a negative terminal of the comparator is connected to one terminal of the reference source, an other terminal of the reference source is connected to an other terminal of the second resistor and a common ground terminal of the phase-cut dimming control circuit; a power terminal of the comparator is connected to a VCC; an output terminal of the comparator is connected to an input terminal of the PWM signal conversion circuit; an output terminal of the PWM signal conversion circuit is connected to a light emitting diode of the photoelectric coupler; a transistor of the photoelectric coupler is connected to an input terminal of the PWM signal adjustment circuit; an output terminal of the PWM signal adjustment circuit is connected to the control terminal of the filed effect transistor.

3. The dimming circuit system of claim 1, wherein the phase-cut dimming control circuit comprises a first diode, a second diode, a first resistor, a second resistor, a third resistor, a comparator, a reference source, a PWM signal conversion circuit, a photoelectric coupler, and a PWM signal adjustment circuit; positive terminals of the first diode and the second diode are respectively connected to two output terminals of the anti-interference circuit; negative terminals of the first diode and the second diode are connected to each other and then connected to one terminal of the first resistor; an other terminal of the first resistor is connected to one terminal of the second resistor and a positive terminal of the comparator; a negative terminal of the comparator is connected to one terminal of the reference source, an other terminal of the reference source is connected to an other terminal of the second resistor and a common ground terminal of the phase-cut dimming control circuit; a power terminal of the comparator is connected to a VCC; an output terminal of the comparator is connected to a positive terminal of a light emitting diode of the photoelectric coupler; a negative terminal of the light emitting diode of the photoelectric coupler is connected to one terminal of the third resistor; an other terminal of the third resistor is connected to a common ground terminal of the phase-cut dimming control circuit; a transistor of the photoelectric coupler is connected to an input terminal of the PWM conversion circuit; an output terminal of the PWM conversion circuit is connected to an input terminal of the PWM signal adjustment circuit; an output terminal of the PWM signal adjustment circuit is connected to the control terminal of the filed effect transistor.

4. A dimming power supply, comprising:

an anti-interference circuit, an active power factor correction circuit, a power conversion circuit, a dimmer current maintaining circuit, a phase-cut dimming control circuit, and a filed effect transistor;

wherein an input terminal of the anti-interference circuit is connected to an output terminal of the phase-cut dimmer, an output terminal of the anti-interference circuit is connected to input terminals of the active power factor correction circuit, the dimmer current maintaining circuit, and the phase-cut dimming control circuit respectively; an output terminal of the active power factor correction circuit is connected to an input terminal of the power conversion circuit; an output terminal of the power conversion circuit supplies an working power to the LED light via the filed effect transistor; a control terminal of the filed effect transistor is connected to an output terminal of the phase-cut dimming control circuit.

5. The dimming power supply of claim 4, wherein the phase-cut dimming control circuit comprises, a first diode, a second diode, a first resistor, a second resistor, a comparator, a reference source, a PWM signal conversion circuit, a photoelectric coupler, and a PWM signal adjustment circuit;

wherein positive terminals of the first diode and the second diode are respectively connected to two output terminals of the anti-interference circuit; negative terminals of the first diode and the second diode are connected to each other, and then connected to one terminal of the first resistor; an other terminal of the first resistor is connected to one terminal of the second resistor and a positive terminal of the comparator; a negative terminal of the comparator is connected to one terminal of the reference source, an other terminal of the reference source is connected to an other terminal of the second resistor and a common ground terminal of the phase-cut dimming control circuit; a power terminal of the comparator is connected to a VCC; an output terminal of the comparator is connected to an input terminal of the PWM signal conversion circuit; an output terminal of the PWM signal conversion circuit is connected to a light emitting diode of the photoelectric coupler; a transistor of the photoelectric coupler is connected to an input terminal of the PWM signal adjustment circuit; an output terminal of the PWM signal adjustment circuit is connected to a control terminal of the filed effect transistor.

6. The dimming power supply of claim 4, wherein the phase-cut dimming control circuit comprises, a first diode, a second diode, a first resistor, a second resistor, a third resistor, a comparator, a reference source, a PWM signal conversion circuit, a photoelectric coupler, and a PWM signal adjustment circuit;

wherein positive terminals of the first diode and the second diode are respectively connected to two output terminals of the anti-interference circuit; negative terminals of the first diode and the second diode are connected to each other and then connected to one terminal of the first resistor; an other terminal of the first resistor is connected to one terminal of the second resistor and a positive terminal of the comparator; a negative terminal of the comparator is connected to one terminal of the reference source, an other terminal of the reference source is connected to an other terminal of the second resistor and a common ground terminal of the phase-cut dimming control circuit; a power terminal of the comparator is connected to a VCC; an output terminal of the comparator is connected to a positive terminal of a light emitting diode of the photoelectric coupler; a negative terminal of the light emitting diode of the photoelectric coupler is connected to one terminal of the third resistor; an other terminal of the third resistor is connected to a common ground terminal of the phase-cut dimming control circuit; a transistor of the photoelectric coupler is connected to an input terminal of the PWM conversion circuit; an output terminal of the PWM conversion circuit is connected to an input terminal of the PWM signal adjustment circuit; an output terminal of the PWM signal adjustment circuit is connected to a control terminal of the filed effect transistor.

* * * * *